US011331234B2

(12) United States Patent
Freudenberger

(10) Patent No.: US 11,331,234 B2
(45) Date of Patent: May 17, 2022

(54) PATIENT SUPPORT DEVICE

(71) Applicant: Siemens Healthcare GmbH, Erlangen (DE)

(72) Inventor: Jörg Freudenberger, Kalchreuth (DE)

(73) Assignee: Siemens Healthcare GmbH, Erlangen (DE)

( * ) Notice: Subject to any disclaimer, the term of this patent is extended or adjusted under 35 U.S.C. 154(b) by 255 days.

(21) Appl. No.: 16/807,323

(22) Filed: Mar. 3, 2020

(65) Prior Publication Data

US 2020/0281785 A1 Sep. 10, 2020

(30) Foreign Application Priority Data

Mar. 5, 2019 (DE) ..... 102019202918.3

(51) Int. Cl.
*A61G 7/015* (2006.01)
*A61G 7/018* (2006.01)

(52) U.S. Cl.
CPC ..... *A61G 7/015* (2013.01); *A61G 7/018* (2013.01)

(58) Field of Classification Search
CPC ... A61G 7/015; A61G 7/018; A61G 13/00–10
USPC ..... 5/613
See application file for complete search history.

(56) References Cited

U.S. PATENT DOCUMENTS 328,460 A * 10/1885 Clark ..... A61G 7/015 5/618
603,632 A * 5/1898 Goodwin ..... A61G 7/015 5/618
633,264 A * 9/1899 Huntington ..... A61G 7/015 5/617
710,304 A * 9/1902 Rose ..... A61G 7/1007 5/219
812,240 A * 2/1906 Schoettl ..... A61G 7/015 5/618
869,911 A * 11/1907 Kintz ..... A61G 7/015 5/617

(Continued)

FOREIGN PATENT DOCUMENTS

CN 1756521 A 4/2006
CN 201058046 Y 5/2008

(Continued)

OTHER PUBLICATIONS

Chinese Office Action for Chinese Application No. 202010146177.8 dated Sep. 13, 2021.

(Continued)

*Primary Examiner* — Myles A Throop
(74) *Attorney, Agent, or Firm* — Lempia Summerfield Katz LLC

(57) ABSTRACT

A patient support device including a patient support board including of at least two board sections, wherein at least one of the at least two board sections may be pivoted with respect to another of the board sections around a pivot axis by a pivoting mechanism. The pivoting mechanism includes two ratchets that may be latched in mutually opposite directions of rotation around the pivot axis and at least one operator control device. At least one of the two ratchets may be moved from a latched state into an open state and/or vice versa by the at least one operator control device.

14 Claims, 4 Drawing Sheets

(56) References Cited

U.S. PATENT DOCUMENTS

| | | | | | |
|---|---|---|---|---|---|
| 1,003,865 | A * | 9/1911 | Barnett | A61G 7/015 | 5/618 |
| 1,194,112 | A * | 8/1916 | Wood | A47C 20/026 | 606/245 |
| 1,373,151 | A * | 3/1921 | Slabinski | A61G 7/015 | 5/618 |
| 1,453,970 | A * | 5/1923 | Bumgardner | A61G 7/015 | 5/617 |
| 1,607,420 | A * | 11/1926 | Williams | A61G 7/015 | 5/618 |
| 3,462,772 | A * | 8/1969 | Morrison | A61G 7/005 | 5/611 |
| 3,741,496 | A * | 6/1973 | Beller | B60R 22/38 | 242/383.1 |
| 4,847,935 | A * | 7/1989 | Alexander | B65G 69/2841 | 14/71.3 |
| 5,943,742 | A * | 8/1999 | Huang | A44B 11/125 | 24/68 CD |
| 6,681,603 | B1 * | 1/2004 | Yu | E05B 67/006 | 30/233 |
| 2006/0207027 | A1 | 9/2006 | Matunaga et al. | | |
| 2007/0116512 | A1 * | 5/2007 | Katzenstein | A61G 13/12 | 403/322.4 |
| 2008/0214976 | A1 | 9/2008 | Memminger | | |
| 2015/0065863 | A1 | 3/2015 | Candidas et al. | | |
| 2017/0252247 | A1 | 9/2017 | Tsumori et al. | | |

FOREIGN PATENT DOCUMENTS

| | | | |
|---|---|---|---|
| CN | 101919773 | A | 12/2010 |
| CN | 104414640 | A | 3/2015 |
| CN | 106604711 | A | 4/2017 |
| DE | 3101373 | A1 | 12/1981 |
| DE | 102005054175 | A1 | 5/2007 |
| EP | 0050079 | A1 | 4/1982 |

OTHER PUBLICATIONS

German Office Action for German Application No. 10 2019 202 918.3 dated Feb. 12, 2020.

* cited by examiner

PATIENT SUPPORT DEVICE

CROSS REFERENCE TO RELATED APPLICATIONS

This patent document claims the benefit of DE 102019202918.3, filed on Mar. 5, 2019, which is hereby incorporated in its entirety by reference.

FIELD

Embodiments relate to a patient support device including a patient support board including of at least two board sections where at least one of the at least two board sections may be pivoted with respect to another of the board sections about a pivot axis by a pivoting mechanism.

BACKGROUND

Patient support devices, for example, patient support tables, may be used to support a patient during medical interventions such as operations or within the context of medical imaging or other examinations. In such situations, the patient may be positioned lying in a supine pose. Extremities or parts of the body of the patient may furthermore be fixed in place, for example, on-board sections. In order to provide desired positions of the patient to be set during the intervention, board sections of the patient support board may be tilted with respect to other board sections, the respective angle set using the natural mobility of parts of the body of the patient relative to one another.

The pivoting position of the boards relative to one another is often fixed by screw and clamp connections or using electromechanical joints or actuators. However, this results in the disadvantage that the solutions are quite difficult to handle for operators or are associated with comparatively high costs.

BRIEF SUMMARY AND DESCRIPTION

The scope of the present invention is defined solely by the appended claims and is not affected to any degree by the statements within this summary. The present embodiments may obviate one or more of the drawbacks or limitations in the related art.

Embodiments provide an improved patient support device, for example, with regard to the simplest possible yet nonetheless convenient or user-friendly locking options.

Embodiments provide a patient support device where the pivoting mechanism includes two ratchets that are latchable in each case in opposite directions of rotation around the pivot axis, as well as at least one operator control device. At least one of the two ratchets may be moved from a latchable state into an open state and/or vice versa by the at least one operator control device.

Thus, if one of the ratchets is disposed in the latched state, then one of the two pivoting directions around the pivot axis is released by the ratchet and the opposite pivoting direction around the pivot axis is locked fast. In the arrangement for both ratchets that the direction of rotation locked in the latched state is that direction of rotation that remains released by the respective other ratchet in the latched state. This results in the possibility that, depending on in which direction the respective board section is currently loaded or is to be relocated, the ratchets may in each case be selectively brought into the open or latched state, as a result of which an unwanted tilting movement, for example, caused by the weight of the patient, may be avoided.

In the patient support device, the desired pivoting position of the respective board section may be set by a tilting of the board section along the released direction of rotation, for example, by medical staff. As an example, a patient is lying in a supine position on a first board section of the patient support board with the patient's hip region being supported thereon in the vicinity of the pivoting mechanism. The legs of the patient are therefore positioned on a second board section that is connected to the first board section by the or a pivoting mechanism. In this case the first ratchet may be in the latched state so that a tilting of the second board section with respect to the first board section is released only in an upward direction, the second ratchet being in the open state. This provides the legs of the patient to be swung upward with respect to the patient's torso, while owing to the latched state of the second ratchet it is not possible for the second board section to swing back due to gravity, and therefore in an unwanted manner. This principle applies equally when extremities of the patient are secured in a suspended position on one of the board sections.

Because both ratchets may be brought into the open state and the latched state, the direction of rotation that is currently latched and the direction of rotation that is currently released may be set at will as necessary. An unwanted pivoting of the board section due to the weight of the patient or of the parts of the body fixed in place on the respective board section may be avoided. It may be necessary for example to lock fast the pivoting direction opposite hereto when the board section in question is positioned in space tilted in such a way that the board section overhangs with respect to the vertical. This is possible for example, when, starting from a board section in a fixed position, several board sections are connected to one another in a concatenated manner by way of a plurality of pivotable connections. Even when one of the board sections is to be swung back in the same direction in which the gravitational force of the patient is also acting, the correspondingly opposite pivoting direction may be latched if for example a resistance on the part of the patient is to be expected.

The board sections that are pivotable relative to one another by the pivoting mechanism may be secured to one another by the pivoting mechanism. The two ratchets may be arranged on opposite sides of the patient support board and may furthermore act as a rotary joint connection between the respective board sections. In addition, further hinged joints may be provided. The two, for example, immediately adjacent, ratchets may be arranged on one side of the patient support board, a freely movable, i.e. non-latchable, hinged joint being provided on the respective opposite side of the patient support board for additional fastening of the respective board sections.

The operator control device, for example a manually operated switch or lever or the like, is provided to provide the ratchets to be moved from the latched state into the open state and/or vice versa in the most convenient and effortless way possible for the medical staff. The ratchets are moved from the latched state into the open state and/or vice versa by the operator control device, for example, by way of the simplest possible operator control action, thereby removing the need for complicated handling operations such as, for example, the latching of hinged joints by screw and clamp connections or the like. Furthermore, the coupling of the operator control device to the ratchets may be purely mechanical in a cost- and energy-saving manner.

The patient support board may include a first board section and a second board section. In this arrangement the first board section may be secured to a lifting column connected to the floor. The lifting column may be adjustable in length in this case, thereby allowing the height of the patient support device to be adjustable. At the same time the angle between the lifting column and the first board section may furthermore be adjustable, thereby allowing the first board section to assume an inclined position with respect to the floor or solid base.

The second board section may be fastened to the first board section by a first pivoting mechanism, a third board section additionally being fastened to the first board section by a second pivoting mechanism. In this embodiment variant it may be provided that the patient's trunk region is supported on the first board section, the head region on the second board section, and the leg region on the third board section. This principle may be continued using further board sections. All of the pivot axes may be fixedly arranged with respect to the first, for example, spatially fixed, board section. In the arrangement all of the pivoting mechanisms may in each case include two ratchets that may be latched in mutually opposite directions of rotation around the respective pivot axis.

Alternatively, the second board section may also be fastened to the first board section by the first pivoting mechanism, and the third board section to the second board section by the second pivoting mechanism, etc., only the pivot axis assigned to the first pivoting mechanism therefore being arranged fixed with respect to the first, for example, spatially fixed, board section, the position of the pivot axis assigned to the second pivoting mechanism being dependent on the current pivoting position of the second board section.

The operator control device may be moved into a number of operating positions, one of the ratchets being in the latched state in a first operating position and the respective other ratchet being in the open state, and the ratchets being in the respective other state with respect to the first operating positions in a second operating position. What is affected thereby is that the currently released direction of rotation around the pivot axis of the board section is defined by whether the operator control device is currently in the first operating position or the second operating position. The patient support board may be initially in a horizontal basic position in which the board sections are disposed at an angle of 180° to one another. While the patient is positioned on the patient support board or is mounting the same, the operator control device may be located in the first operating position such that it is not possible for the associated board section to be tilted downward. Nonetheless, it is however possible in this situation to tilt the board section upward and thus transfer the patient into the position required for the medical intervention. Following termination of the intervention or to perform a further step necessitating a different support position, the operator control device may be moved from the first operating position to the second operating position, in which case the associated board section may be swiveled back again in the direction of the thus released pivoting direction, for example, with the assistance of the medical staff, into the horizontal position or at least the direction thereof.

The operator control device may be moved by way of the simplest possible, for example, manual, operator action on the operator control device from the first operating position to the second operating position and vice versa. For this purpose, the operator control device may be for example a pivotable lever, the transition from the first operating position to the second operating position and vice versa being affected for example by the operator control device being pivoted into a corresponding angular position. Equally, the operator control device may be a switch, for example, a toggle switch, where different positions of the switch represent the respective operating positions. Furthermore, the operator control device may be a bar, possibly with a handle, that is displaceable with respect to a longitudinal axis. Further, for example, up to four different, operating positions of the operator control device are conceivable in the connection.

The operator control device may further be moved into a latched operating position in which all the ratchets are in the latched state and/or into an open operating position in which all the ratchets are in the open state. If all of the ratchets of the pivoting mechanism are located in the latched state, then it is no longer possible to tilt the associated board section in either of the two directions of rotation around the pivot axis. In this state, the respective board section is fixedly latched with respect to a pivotability. If the operator control device is located in the open operating position in which all the ratchets of the pivoting mechanism are in the open state, then a tilting of the associated board section is possible without restriction in any direction, that may be useful for example as part of a preparatory setting and/or a cleaning of the patient support board or the like.

In addition to the ratchets arranged on opposite sides of the patient support board, the pivoting mechanism includes two further ratchets that are latchable in mutually opposite directions of rotation around the pivot axis, each of the two further ratchets arranged in each case adjacent to one of the two ratchets and latchable with respect to the respective adjacent ratchet in the respective opposite directions of rotation around the pivot axis. This results in two ratchets provided in each case on the opposite sides of the patient support board with latchable directions of rotation being disposed opposite one another in each case. Alternatively, it may be provided with respect to the two further ratchets that the two further ratchets are arranged adjacent to one another and between the ratchets, for example, centrally.

An improvement in stability is achieved in both cases. When the operator control device is in the first operating position or the second operating position, the latching action is no longer realized on one side of the patient support board only, as a result of which one-sided loads or strong lever effects, and consequently excessive wear and tear of the pivoting mechanism, are avoided.

The ratchets in each case may include a toothed gearwheel having at least one associated pawl, the ratchets being latchable by an engagement of the respective at least one pawl between the teeth of the respective toothed gearwheel. A tilting of the respective board section in this case effects a rotational movement between the toothed gearwheel and the pawl. Detent connections of the type may also be referred to as locking mechanisms or safety catches, such that two counterrotating locking mechanisms are therefore provided as ratchets.

For example, in the case of a first board section, for example in a fixed position and connected to the lifting column, the toothed gearwheels of the assigned ratchets may be secured to the first board section, for example, likewise in a fixed or non-rotational position, the pawl arranged on the board section that may be pivoted with respect to the first board section. The teeth of the toothed gearwheel may be asymmetric in shape, the pawl, or a fastening by which the pawl is secured may be elastic.

The latched state, due to the asymmetry and elasticity of the pawl or a fastening, that may be for example, a leg spring or the like, causes a rotation of the pawl around the toothed gearwheel along the released direction causes the teeth to press the pawl radially outward counter to an elastic restoring force during this movement and consequently the movement is not blocked. During a corresponding tilting movement, the pawl therefore passes through a plurality of detent positions, in which process a typical detent noise may be generated as the pawl engages by spring action in the respective detent positions. A user may therefore infer from the clicking of the pawl that just at this moment the latter is located in a detent position with respect to the opposite direction of rotation and consequently the user may release the respective board section without the board section swinging back. In this case the pawl latches into the asymmetrically shaped teeth or the detent position most recently engaged by spring action, thereby causing a further rotation in this direction to be blocked. In order to release this direction of rotation, e.g. to move the ratchet into the open state, the pawl may be moved away for this purpose in the radial or axial direction with respect to the toothed gearwheel, thereby releasing the engagement of the pawl between the teeth of the toothed gearwheel. In this position, the rotation is therefore released, thereby providing the tilting movement in both directions.

The toothed gearwheels assignable to the pivoting mechanism may be disposed relative to one another in such a way that the detent positions of the toothed gearwheels are identical with respect to the pivoting position of the associated board section. Furthermore, the toothing of the toothed gearwheels may not be completely continuous in the radially circumferential direction. For example, the toothing may be interrupted in radial sections of the toothed gearwheel that are assigned to pivot positions of the respective associated pivoting board that cannot be assumed anyway.

All the pawls may be fastened to a bar extending parallel to the pivot axis, the bar movable into a number of bar positions by a displacement along the bar's longitudinal axis, one of the ratchets in the latched state in a first bar position and the respective other ratchet in the open state, and the ratchets in the other state with respect to the first bar position in a further second bar position. With respect to the longitudinal axis, the pawls therefore protrude from the bar, for example, laterally, as a result of which a displacement of the bar along the bar's longitudinal axis causes the pawls to be displaceable into respective positions in which the pawls engage or do not engage between the respective teeth of the respective assigned toothed gearwheel. To provide or facilitate the lateral inward movement of the pawls between the teeth of the respective toothed gearwheels, the toothed gearwheels or the respective teeth include corresponding lead-in bevels for this purpose to allow the pawl to latch effortlessly into the engagement position.

Fastened to a bar, the pawls include a permanently predefined spacing from one another in each case, as a result of which it is clearly defined, in each bar position, that of the ratchets are in the latched state and that are in the open state. Preferred states of the latching mechanisms may therefore be set without this necessitating a separate setting of individual ratchets. The respective bar positions may in this case be locked fast by a decent connection. The bar may include bores or cutouts along the bar's longitudinal axis into which corresponding detents such as bolts or the like engage in a correspondingly releasable manner.

The bar may be moved into a latched bar position in which all the ratchets are in the latched state, and/or into an open bar position in which all the ratchets are in the open state. although a ratchet may have only one toothed gearwheel, it may nonetheless include a plurality of pawls.

The operator control device may be coupled to the bar directly or via a coupling mechanism in such a way that the bar may be moved by the operator control device into the plurality of bar positions. The transfer of the operator control device into the first operating position may cause the bar to be moved into the first bar position. The same applies equally to the second bar position and the second operating position, to the latched bar position and the latched operating position, as well as to the open bar position and the open operating position.

In this case the operator control device may be a handle or grip or the like, for example, provided at the front end of the bar. Equally, the operator control device may also be simply the front-end section of the bar. The bar may more or less finally be conveyed by way of manual operation actions on the operator control device directly, i.e. without further electromechanical mechanisms, into the desired bar position.

By way of example, the difference between the individual bar positions is by how far the bar or the operator control device protrudes from the patient support board. The difference between the various operating positions may be a matter of a few millimeters or centimeters.

Alternatively or in addition, a further operator control device is connected to a control unit of the patient support device, the control unit configured to generate a control command as a function of an operator control signal indicating an operator control input performed using the operator control device and to send the control command to at least one electromechanical actuator to move at least one of the ratchets in the latched state into the open state and/or vice versa. The operator control device may in this case be a keypad or a touchscreen or the like.

The pivoting mechanism may include a lock by way of which the pivoting with respect to both directions of rotation around the pivot axis may be locked fast, the lock movable from a locked-fast locking state into a released locking state and/or vice versa by a locking operator control device. The locking operator control device may be provided in addition to the operator control device. The lock therefore provides the pivoting of the board section to be locked with respect to both pivoting directions, completely independently of the state of the ratchets and may prevent an unwanted tilting movement from taking place due, for example, to an incorrect setting of the operator control device. Thus, it may be provided for example that the lock is unconditionally moved into the locked-fast locking state as soon as the desired position or the desired angle of the board sections has been reached, thereby automatically ruling out an unwanted tilting movement due to an incorrect setting of the operator control device.

A clamping device assigned for example to the pivoting mechanism or a detent device in which bolts engage in bores extending parallel to the pivot axis in the toothed gearwheels may be provided as lock, for example. The locking operator control device may be a further lever or a switch or the like.

If the lock and the locking operator control device are provided, the operator control device may be movable only into the first operating position, the second operating position and the open operating position, since the latched operating position of the operator control device is redundant in this case.

The locking operator control device may be coupled directly or via a locking coupling mechanism to the lock in such a way that the lock may be moved by the locking operator control device from the locked-fast locking state into the released locking state and vice versa. With regard to the locking operator control device or the lock also, a purely mechanical implementation is therefore conceivable in which electromechanical actuators are dispensed with completely. The locking coupling mechanism may be for example a Bowden cable or include a Bowden cable.

The pivotable board section includes a handle, embodied for example, as an opening in the board section, in the vicinity of one of the sides facing away from the pivot axis side, the locking operator control device, embodied for example, as a lever, being arranged in the vicinity of the handle. In this arrangement the handle may be used for performing the tilting movement of the board section manually. If the locking operator control device is arranged in the vicinity of the handle, the lock may be moved into the released lock state only when a hand is simultaneously positioned in the vicinity of the handle, for example, in order to tilt the board section in question by the handle, as a result of which an unwanted tilting of the board section, e.g. caused by the weight of the patient, may be prevented.

The lock may be coupled to a restoring element, a force of the restoring element acting on the lock acting in the direction of the locked-fast lock state. Provided no other force is exerted on the locking operator control device, this causes the lock to be automatically moved into the locked-fast lock state or to remain in the state, that represents an additional safeguard in respect of an unwanted tilting or dropping of the respective board section. The restoring element may in this case be embodied as an elastic spring element. The spring element, that is e.g. a coil spring, may be coupled herein to bolts of the lock, the restoring element pressing the bolts for example into a position engaging in cutouts of the toothed gearwheel.

At least one of the pivotable board sections may include a lateral cutout or opening on a side facing toward the pivot axis so that extremities and/or parts of a patient's body may be passed through. This for example allows extremities or parts of the patient's body to be secured in a suspended position on one of the board sections. A first board section, for example, connected to a lifting column and permanently aligned horizontally, is connected via the pivoting mechanism to a second board section, the second board section having a lateral cutout on a side facing toward the pivot axis. The second board section may be tilted upward, in which case the arms of the patient lying in a prone position on the first board section may be guided through the cutout and secured to the second board section from below. A possible third board section may be used, in which case the legs of the patient for example may be guided through a lateral cutout in the third board section and then secured to the underside of the third board section.

A looped hanger strap provided for receiving parts of the or a patient's body may be arranged on at least one of the board sections. In this case the extremity or part of the patient's body that is to be secured in a suspended manner on the respective board section may therefore be guided through the hanger strap loop, that may be made for example from plastic or leather or the like, in which case the hanger strap loop may subsequently be pulled tight and the extremity fixed in place in the hanger strap by a prong buckle assigned to the hanger strap. It is also conceivable for several, for example, two, hanger straps to be provided on a board section.

DETAILED DESCRIPTION

Figure 1:
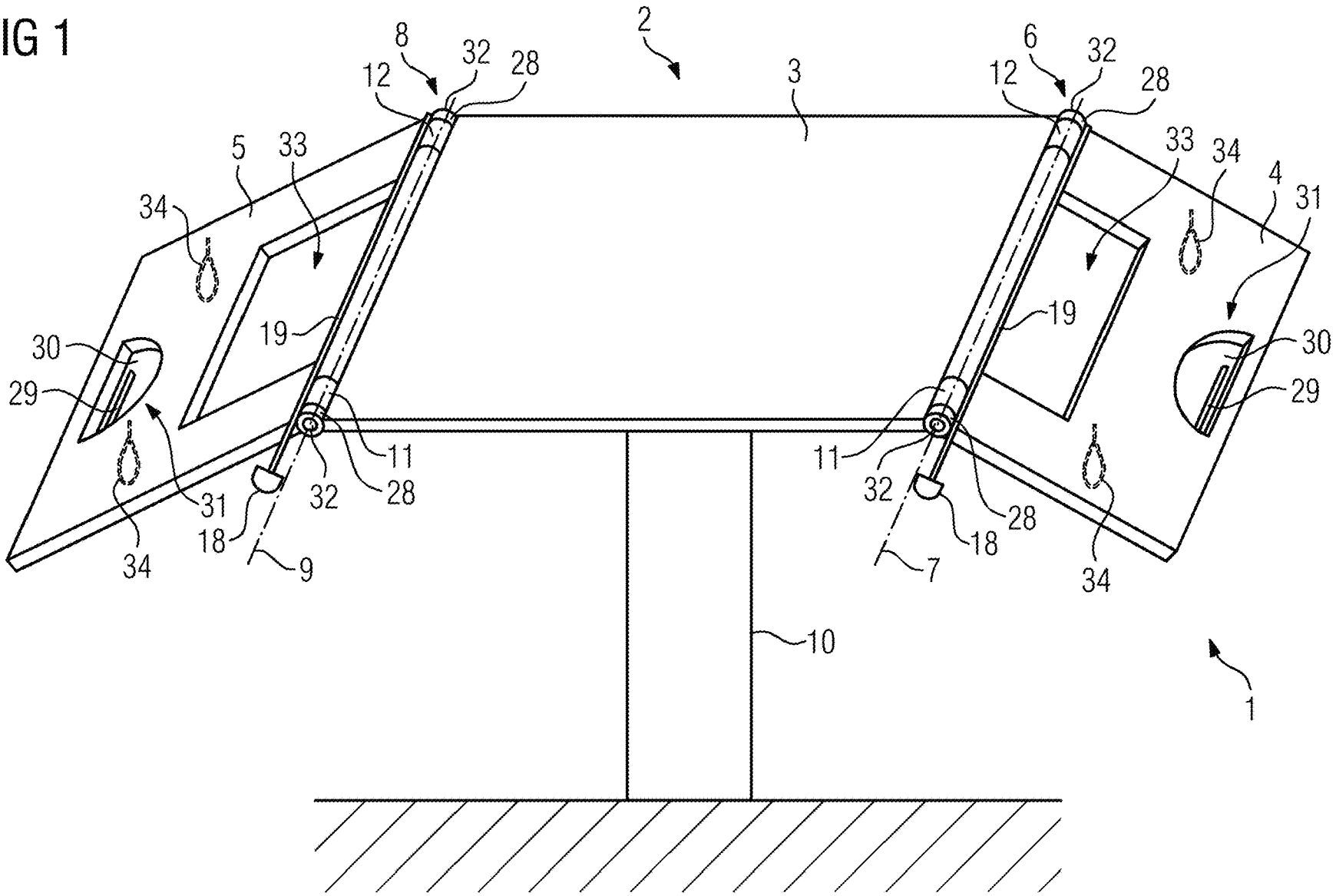
FIG. 1 depicts a patient support device according to an embodiment.

The patient support device 1 depicted in FIG. 1 includes a patient support board 2, embodied in three parts by way of example. The patient support board 2 includes a first board section 3, a second board section 4 and a third board section 5. The second board section 4 is connected to the first board section 3 by a first pivoting mechanism 6 so as to be pivotable around a first pivot axis 7. The third board section 5 is connected to the first board section 3 via a second pivoting mechanism 8 so as to be pivotable around a second pivot axis 9. The height of the patient support device 1 is adjustable by a height-adjustable lifting column 10 connected to the first board section 3. In this arrangement the first board section 3 is fixedly connected to the upper front end of the lifting column 10. In this connection the first board section 3 may be pivoted with respect to the lifting column 10 around at least one horizontal pivot axis, as a result of which the first board section 3 may be tilted into inclined positions.

The pivoting mechanism 6 includes a first ratchet 11 and a second ratchet 12. In order to stabilize the patient support device 1, the pivoting mechanism 6 includes further rotary joints (not shown in further detail) via which the second board section 4 is secured to the first board section 3. The first ratchet 11 and the second ratchet 12 may each be moved into a latched state and an open state.

For the first ratchet 11 that in the latched state (with respect to the front-side perspective shown in FIG. 1) the ratchet arrests or blocks a tilting of the second board section 4 in the counterclockwise direction of rotation around the pivot axis 7. A tilting of the second board 4 in the clockwise direction around the pivot axis 7 is released by the first ratchet 11, that is disposed in the latched state. If the first ratchet 11 is disposed in the open state, then the ratchet 11 releases both directions of rotation around the pivot axis 7.

The same applies analogously to the second ratchet 12, albeit with the difference that when the second ratchet 12 is disposed in the latched state, a tilting in the counterclockwise direction of rotation around the pivot axis 7 is released and a tilting in the clockwise direction of rotation around the pivot axis 7 is locked. If the first ratchet 12 is disposed in the open state, then the ratchet 12 releases both directions of rotation around the pivot axis 7.

The same principle applies to the second pivoting mechanism 8, like reference signs being used in FIG. 1 for like components.

Figure 2:
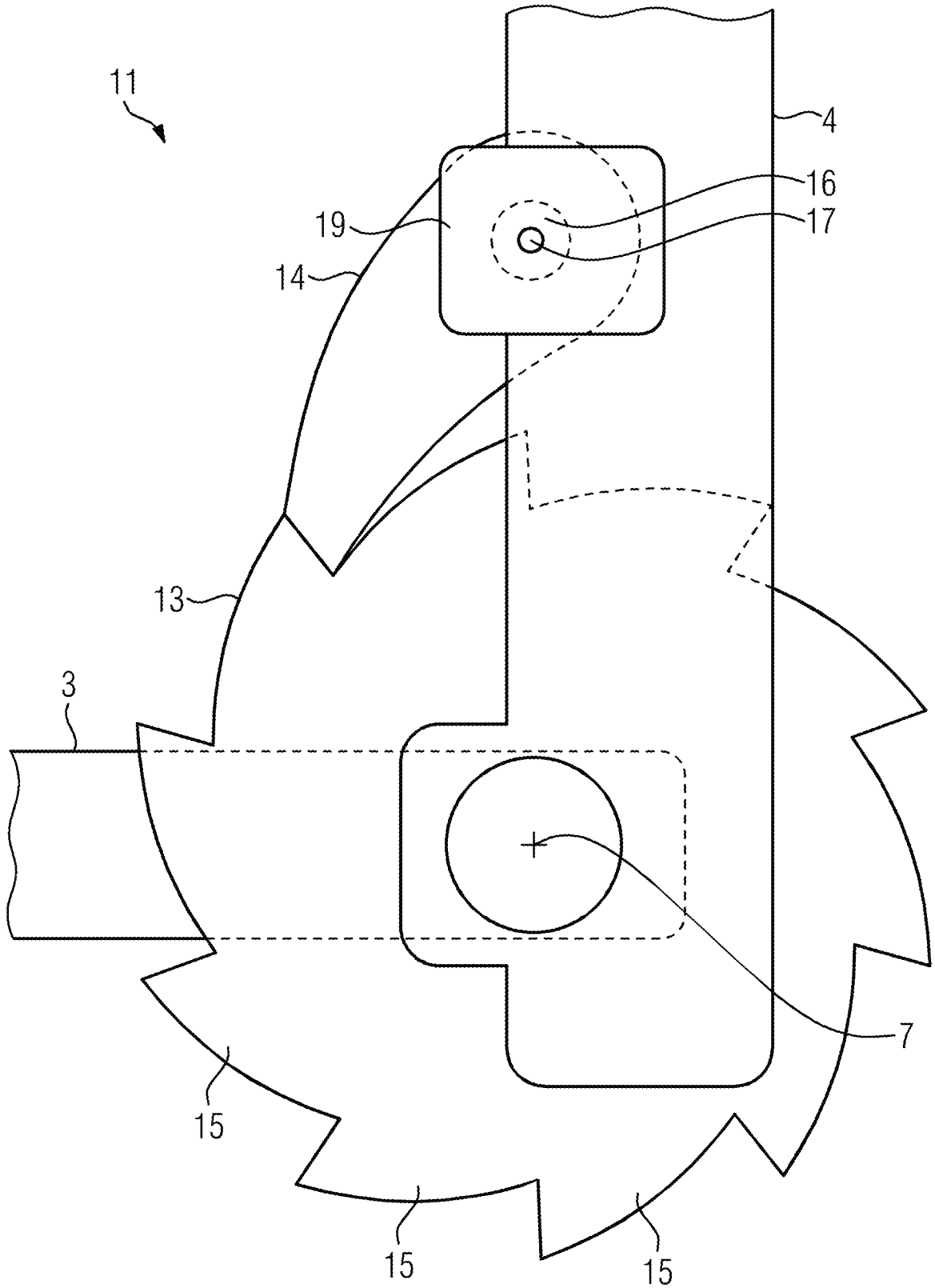
FIG. 2 depicts a ratchet of the patient support device from FIG. 1 according to an embodiment.

FIG. 2 depicts a detail view onto the first ratchet 11, the second board section 4 being tilted into a vertical position. The first ratchet 11 includes a toothed gearwheel 13 fixedly connected to the first board section 3 as well as a pawl 14 assigned to the second board section 4. The pawl 14 is fastened to a bar 19 standing perpendicularly on the drawing plane of FIG. 2, that bar may be tilted together with the second board section 3. In FIG. 2, the first ratchet 11 is located in the latched state. The pawl 14 engages between teeth 15 of the toothed gearwheel 13. The teeth 15 of the toothed gearwheel 13 may be asymmetric in shape, while the shape of the pawl 14 is contoured to match the geometric shape of the teeth 15 in such a way that a further tilting in the counterclockwise direction is blocked.

A tilting of the second board section 4 in the clockwise direction is provided in the latched state of the ratchet 11 depicted in FIG. 2 in that the pawl 14 is fastened to the bar 19 by a joint 16, a leg spring 17 being arranged in the vicinity of the joint 16 and applying a force to the pawl 14. The force causes a rotation of the pawl 14 directed in the counterclockwise direction with respect to FIG. 2. Tilting the second board section 4 in the clockwise direction therefore causes the pawl 14 to be pressed upward against the spring force of the leg spring 17, i.e. in the clockwise direction around the joint 16, until the pawl springs back into the next interspace between two teeth 15 of the toothed gearwheel 13 and engages in the next detent position. The same principle applies to the second ratchet 12, the geometric shapes of the toothed gearwheel 13 or pawl 14 with respect to the first ratchet 11 being provided in mirrored fashion in this case.

The operating principle of the second ratchet 12 is based on the same operating principle as the first ratchet 11, the second ratchet likewise including a toothed gearwheel 20 and a pawl 21.

The patient support device 1 further includes an operator control device 18 via which the ratchets 11, 12 may be moved from the latched state into the open state and vice versa. The operator control device 18 is fastened to a front-side end of the bar 19 arranged on the second board section 4, the bar 19 extending parallel to the pivot axis 7 and movable or displaceable into a plurality of bar positions along a longitudinal axis. The second board section 4 includes, for example as depicted in FIG. 2, a corresponding cutout or groove in which the bar 19 at least partially extends. Equally, the bar 19 may not be disposed in a cutout of the board section 4, but instead be arranged along the front face of the second board 4 facing toward the pivot axis 7. Although the bar 19 is arranged on the second board 3 and may therefore be tilted together with the latter, the bar 19 may also be arranged with the pawl 14 on the stationary first board 2, the toothed gearwheel 13 assigned to the second board 3 and rotating with respect to the pawl 14 as the second board 3 is tilted.

All of the pawls 14, 21 assignable to the pivoting mechanism 6 are fastened to the bar 19 by hinged joints 16. By displacing the bar 19 it is possible to move the pawls 14, 21 from the position engaging between the teeth 15 of the respective toothed gearwheel 13, 20 into a position in which the respective pawl 14, 21 no longer engages between the teeth 15. To that end, the pawls 14, 21 are displaced in the direction perpendicular to the second direction of FIG. 2, i.e. in the axial direction with respect to the toothed gearwheel 13. By a displacement of the bar 19, that may be affected manually by the operator control device 18, the ratchets 11, 12 may be moved from the latched state into the open state and vice versa.

Figure 3:
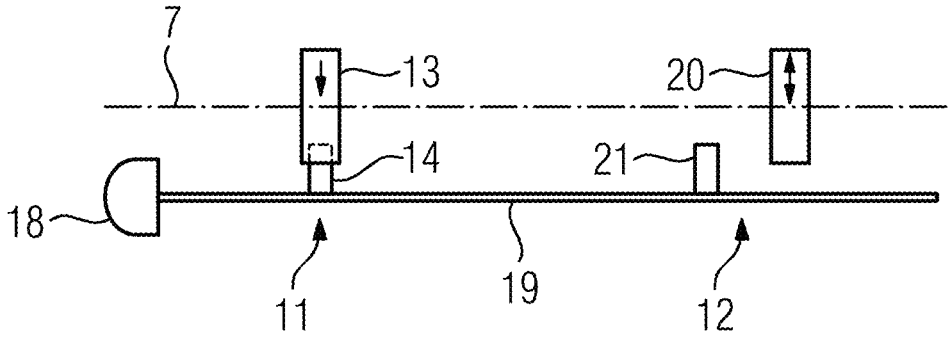
FIGS. 3-5 depict possible operating positions or bar positions of the patient support device from FIG. 1 according to an embodiment.
Figure 4:
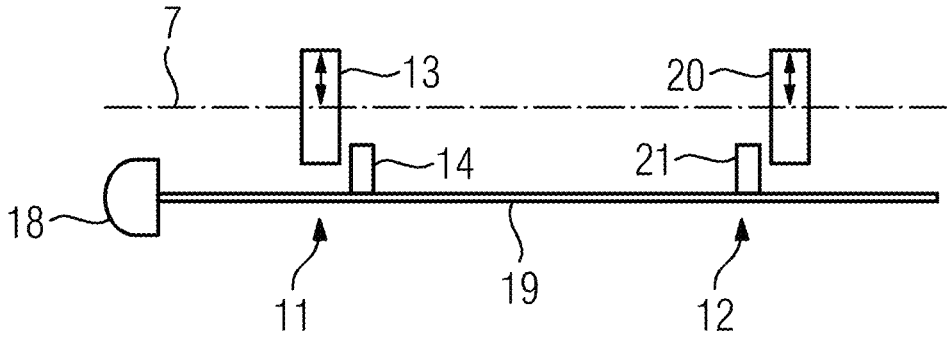
Figure 5:
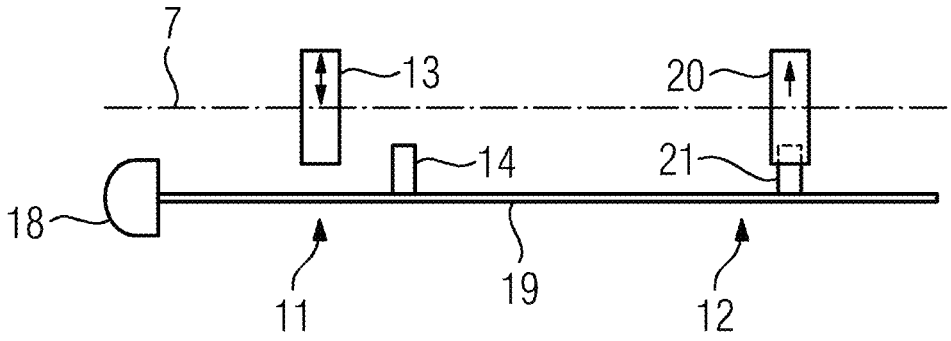

Possible operating positions of the operator control device 18 or bar positions of the bar 19 are depicted in FIGS. 3, 4 and 5. Only the operator control device 18, the bar 19 and the first ratchet 11 including the toothed gearwheel 13 and the pawl 14 as well as the second ratchet 12 including the toothed gearwheel 20 and the pawl 21 are depicted. In FIG. 3, the operator control device 18 is disposed in a first operating position and the bar 19 in a first bar position. The first ratchet 11 is disposed in the latched state, i.e. the pawl 14 engages between the teeth 15 of the toothed gearwheel 13, as a result of which, referring to FIG. 1, the first ratchet 11 releases a tilting movement of the second board section 4 only in the clockwise direction of rotation around the pivot axis 7, whereas a tilting of the second board section 4 in the counterclockwise direction is blocked by the first ratchet 11. The released pivoting direction is in this case depicted in FIG. 3 by the downward-pointing arrow on the toothed gearwheel 13. In FIG. 3, the first operating position or in the first bar position the second ratchet 12 is in the open state, as a result of which the second ratchet 12 releases a tilting potential of the second board section 4 along both pivoting directions, as in FIG. 3 by the upward- and downward-pointing double arrow on the toothed gearwheel 20. As depicted in FIG. 3, the second board section 4 may be tilted only in the clockwise direction of rotation around the pivot axis 7.

Compared to the situation depicted in FIG. 3, in FIG. 4 the bar 19 or the operator control device 18 is shifted with respect to a longitudinal axis only a little further in the direction of the patient support board 2. Depending on how wide the components 13, 14, 20, 21 are, the difference in this case may amount to only a few millimeters or centimeters. In the situation depicted in FIG. 4, the operator control device 18 is disposed in an open operating position and the bar 19 in an open bar position, with neither of the two pawls 14, 21 engaging in the respective associated toothed gearwheels 13, 20 and the ratchets 11, 12 both in the open state. Both ratchets 11, 12 each release both directions of rotation around the pivot axis 7, for which reason the second board section 4 may be tilted in both directions when the operator control device 18 is disposed in the open operating position or the bar 19 is disposed in the open bar position.

In FIG. 5, the operator control device 18 is disposed in a second operating position and the bar 19 in a second bar position. Compared to the situation depicted in FIG. 4, the operator control device 18 or the bar 19 is shifted with respect to a longitudinal axis only a little further in the direction of the patient support board 2. In FIG. 5, the first ratchet 11 is disposed in the open state and the second ratchet 12 is disposed in the latched state, the second ratchet 12 providing the second board section 4 to be tilted only in the counterclockwise direction around the pivot axis 7, as is symbolized by the upward-pointing arrow on the toothed gearwheel 20. When the operator control device 18 is disposed in the second operating position or when the bar 19 is disposed in the second bar position, a tilting of the second board section 4 is possible only in the counterclockwise direction around the pivot axis 7.

The operator control device 18 may be moved into a latched operating position and the bar 19 into a latched bar position. For this purpose, referring to the situation depicted in FIG. 5, the bar 19 or the operator control device 18 is pushed in a little further still to the right, in which case two additional pawls are provided in each case, that are arranged on the bar 19 in each case immediately to the left next to the toothed gearwheels 13, 20. As a result of the displacement of the bar 19 a little further to the right, the two additional pawls are in each case brought into engagement with the toothed gearwheels 13, 20, thereby moving both ratchets 11, 12 into the latched state.

Figure 6:
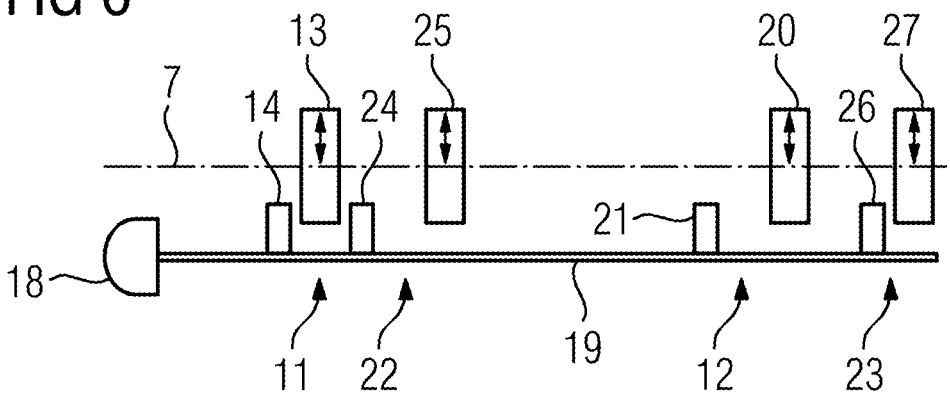
FIGS. 6-8 depict possible operating positions or bar positions according to embodiments.
Figure 7:
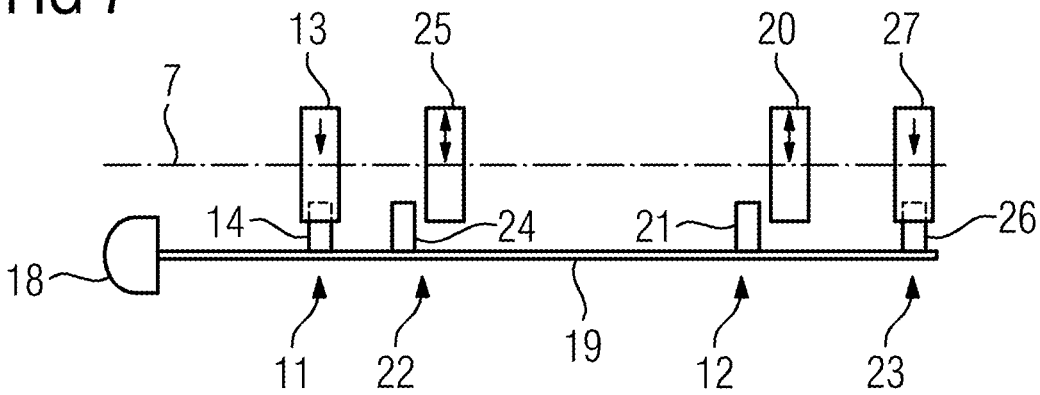
Figure 8:
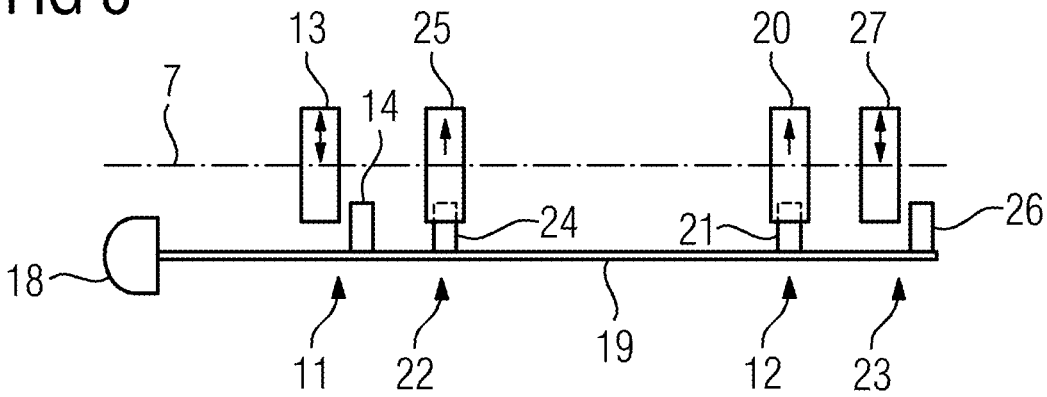

A further embodiment of a patient support device 1 is depicted in FIGS. 6, 7 and 8. Only the operator control device 18 with the bar 19 as well as associated ratchets 11, 12, 22, 23 are shown here in each case, analogously to FIGS. 3, 4 and 5. In addition to the first ratchet 11 and the second ratchet 12, a further first ratchet 22 and a further second ratchet 23 are provided in this case. The ratchets 22, 23 operate according to the same principle as the ratchets 11 and 12. Thus, the ratchet 22 includes a pawl 24 and a toothed gearwheel 25, and the second further ratchet 23 includes a pawl 26 and a toothed gearwheel 27. The further ratchets 22, 23 of the pivoting mechanism 6 may be latched in this case in respective opposite directions of rotation around the pivot axis 7 and are arranged on opposite sides of the patient support board 2. The resulting redundancy of the ratchets 11, 12 produces an increase in the stability of the patient support device 1. For example, this avoids only one of the ratchets 11, 12 on one of the two sides of the patient support board 2 in each case being in the latched state, that could result in comparatively strong lever effects acting on the ratchet 11, 12 in question. This therefore counteracts an excessive wear and tear on the pivoting mechanism 6.

FIG. 6 depicts where the operator control device 18 is in the open operating position or the bar 19 is in the open bar position. It is indicated in each case by the upward- and downward-pointing double arrows on the toothed gearwheels 13, 20, 25, 27 that both directions of rotation around the pivot axis 7 are released by the respective ratchet 11, 12, 22, 23.

In FIG. 7, the operator control device 18 is disposed in the first operating position or the bar 19 in the first bar position. The first ratchet 11 and the second further ratchet 23 are disposed in the latched state, thereby releasing a tilting of the second board section 4 only in the clockwise direction of rotation around the pivot axis 7. This is indicated by the two downward-pointing arrows on the toothed gearwheels 13, 27. In FIG. 8, the operator control device 18 is disposed in the second operating position or the bar 19 is disposed in the second bar position, in which a tilting of the second board section 4 is possible only in the counterclockwise direction of rotation around the pivot axis 7. The further first ratchet 22 and the second ratchet 12 are disposed in the latched state, while the two other ratchets 11, 23 are in the open state.

As depicted in FIG. 1, the pivoting mechanism 6 of the patient support device 1 includes a lock 28. The lock 28 includes by way of example two clamping devices that are arranged on the opposite sides of the patient support board 2, on which the first board section 3 is hinged with the second board section 4. The tilting of the second board section 4 with respect to both directions of rotation around the pivot axis 7 may be prevented by the lock 28. The lock 28 may be moved from a locked-fast lock state into a released lock state and vice versa by way of a locking operator control device 29. In this case the locking operator control device 29 is embodied by way of example as an operator control lever that is arranged in the vicinity of a handle 30 that is embodied as an opening 31 in the second board section 4. The handle 30 is in this case arranged at the front side of the second board 4 facing away from the pivoting mechanism 6 or pivot axis 7 and serves to provide easier operability during the tilting of the second board section 4. Owing to the spatial proximity of the handle 30 to the locking operator control device 29, the second board section 4 may be tilted in the most user-friendly manner possible together with the manual transition of the lock 28 from the released lock state into the fixed lock state or vice versa. The locking operator control device 29 may be coupled to the lock 28 via a locking coupling mechanism (not shown in further detail and for example, a Bowden cable) via which the transition of the lock 28 from the locked-fast lock state into the released lock state and vice versa is facilitated.

The lock 28 is furthermore coupled to a restoring element 32 that is embodied by way of example as an elastic spring that applies a force to the lock 28 in such a way that the lock 28 is pressed into the locked-fast lock state. Provided no further external force acts on the lock 28, for example, via the locking operator control device 29, the lock 28 is therefore disposed in the locked-fast lock state, thereby realizing a securing of the second board 4 with respect to a tiltability.

To perform a tilting movement of the second board 4, the medical staff may move the operator control device 18 into the desired operating position for this purpose, the lock 28 moved in the next step by the locking operator control device 29 into the released lock state and then, for example, as part of a single movement sequence on the handle 30, the second board 4 being tilted into the desired position. As soon as the locking operator control device 29 is released again, the restoring element 32 causes the lock 28 to be automatically moved into the locked-fast lock state once again and the second board 4 is consequently secured with regard to an unwanted tilting movement.

Like the second board section 4, the third board section 5 is also assigned a corresponding lock 28 having an associated locking operator control device 29 as well as a restoring element 32.

The second board section 4 and the third board section 5 each include a lateral cutout 33 on the side facing toward the respective pivoting mechanism 6, 8 or pivot axis 7, 9, allowing parts of the body or extremities of the patient, the latter lying for example, on the first board section 3, to be passed through. A pair of looped hanger straps 34 is provided in each case on the second board section 4 and the third board section 5 for the purpose of receiving the extremities or parts of the body of the patient. In the position of the patient support device 1 depicted in FIG. 1, the hanger straps are located on the side of the second board section 4 or third board section 5 that is not visible, for which reason the hanger straps 34 are indicated in FIG. 1 simply by dashed lines.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A patient support device comprising:

a patient support board comprising at least two board sections, wherein at least one of the at least two board sections is configured to pivot with respect to another of the board sections around a pivot axis by a pivoting mechanism;

wherein the pivoting mechanism comprises two ratchets configured to be latched in mutually opposite directions of rotation around the pivot axis and at least one operator control device;

wherein at least one of the two ratchets is configured to move by the at least one operator control device from a latched state into an open state.

2. The patient support device of claim 1, wherein the operator control device is configured to move into a plurality of operating positions; wherein in a first operating position one of the ratchets is in the latched state and a respective other ratchet is in the open state, and in a second operating position the ratchets are in the respective other state with respect to the first operating positions.

3. The patient support device of claim 2, wherein the operator control device is further configured to move into a latched operating position in which all the ratchets are in the latched state or into an open operating position in which all the ratchets are in the open state.

4. The patient support device of claim 1, wherein the pivoting mechanism further comprises two further ratchets that are latchable in mutually opposite directions of rotation around the pivot axis;

wherein each of the two further ratchets is arranged in each case adjacent to one of the two ratchets and is latchable with respect to a respective adjacent ratchet in the respective opposite directions of rotation around the pivot axis or each of the two further ratchets are arranged adjacent to one another and between the ratchets.

5. The patient support device of claim 1, wherein the ratchets each comprise a toothed gearwheel comprising at least one assigned pawl, wherein the ratchets are configured to be latched by an engagement of the respective at least one pawl between teeth of the respective toothed gearwheel.

6. The patient support device of claim 5, wherein all the pawls are fastened to a bar extending parallel to the pivot axis, wherein the bar is configured to move into a plurality of bar positions by a displacement along a longitudinal axis, wherein in a first bar position one of the ratchets is in the latched state and a respective other ratchet is in the open state, and in a second bar position the ratchets are in the other state with respect to the first bar position.

7. The patient support device of claim 6, wherein the bar is configured to move into a latched bar position in which all the ratchets are in a latched state or into an open bar position in which all the ratchets are in the open state.

8. The patient support device of claim 6, wherein the operator control device is coupled to the bar directly or via a coupling mechanism so that the bar is configured to move into the plurality of bar positions by the operator control device.

9. The patient support device of claim 1, wherein the pivoting mechanism comprises a lock configured to lock fast the pivoting mechanism tilting with respect to both directions of rotation around the pivot axis, wherein the lock is configured to move from a locked-fast lock state into a released lock state or from the released lock state to the locked-fast lock state by a locking operator control device.

10. The patient support device of claim 9, wherein the locking operator control device is coupled to the lock directly or via a locking coupling mechanism such that the lock is configured to move from the locked-fast lock state into the released lock state and the released lock state to the locked-fast lock state by the locking operator control device.

11. The patient support device of claim 9, wherein the pivotable board section comprises a handle configured as an opening in the pivotable board section in a vicinity of one of the pivotable board section's sides facing away from the pivot axis, wherein the locking operator control device is configured as a lever and is arranged in a vicinity of the handle.

12. The patient support device of claim 9, wherein the lock is coupled to a restoring element, wherein a force of the restoring element acting on the lock acts in the direction of the locked-fast lock state.

13. The patient support device of claim 1, wherein at least one of the pivotable board sections includes a lateral cutout or opening on a side facing toward the pivot axis, the lateral cutout or opening configured to allow parts of a patient's body to be passed through.

14. The patient support device of claim 1, further comprising:

a looped hanger strap configured for receiving parts of a patient is arranged on at least one of the board sections.

* * * * *